United States Patent [19]

Urness et al.

[11] Patent Number: 4,766,668

[45] Date of Patent: Aug. 30, 1988

[54] PITCH TRANSITION WIRE GUIDE APPARATUS

[75] Inventors: Kevin Urness, Elmhurst; Leonard J. Lickus, Plainfield; Douglas Heisner, Downers Grove; Peter Ingwersen, Cary; Eric Stenstrom, Des Plaines, all of Ill.

[73] Assignee: Molex Incorporated, Lisle, Ill.

[21] Appl. No.: 17,651

[22] Filed: Feb. 24, 1987

[51] Int. Cl.[4] ..... H01R 43/01

[52] U.S. Cl. ..... 29/749; 29/857; 140/147

[58] Field of Search ..... 29/749, 750, 759, 857, 29/863, 866; 140/147

[56] References Cited

U.S. PATENT DOCUMENTS

| | | | |
|---|---|---|---|
| 2,337,055 | 12/1943 | Mathias et al. | 140/147 X |
| 3,157,721 | 11/1964 | Barish | 29/759 X |
| 4,043,017 | 8/1977 | Folk et al. | 29/759 X |
| 4,125,137 | 11/1978 | Shatto, Jr. | 140/147 |
| 4,235,015 | 11/1980 | Funcik et al. | 29/857 |
| 4,372,041 | 2/1983 | Winkelman | 29/564.4 |
| 4,476,628 | 10/1984 | Kees, Jr. | 29/861 |
| 4,614,028 | 9/1986 | Rich | 29/749 |

FOREIGN PATENT DOCUMENTS

| | | | |
|---|---|---|---|
| 2927401 | 1/1981 | Fed. Rep. of Germany | 29/857 |

*Primary Examiner*—Mark Rosenbaum
*Assistant Examiner*—Andrew E. Rawlins
*Attorney, Agent, or Firm*—John W. Cornell; Louis A. Hecht

[57] ABSTRACT

A pitch transition wire guide apparatus for use in wire harness fabrication machines includes a plate member having a wire engaging edge and a corresponding number of open-ended wire guide channels, each extending inwardly from the edge to a closed end. The closed ends of said channels are spaced apart by a centerline spacing different from the centerline spacing of the open ends in said edge. The plate is reciprocably moveable between a first position wherein the open ends are in surrounding engagement with the wires adjacent the edge and a second wire-receiving position wherein said wires are disposed at the closed ends. The guide includes actuation means for moving the plate member between said first and second positions. Actuation of the wire guide causes movement of the wires within their respective channels to alter the centerline spacing thereof. The wire guide is useful for making smooth continuous transitions between production runs of different pitch wire harnesses. It is also useful for making pitch transition wire harnesses wherein a common group of wires are terminated to at least two connectors, each one containing terminals spaced apart at different centerline spacings.

9 Claims, 4 Drawing Sheets

FIG.1
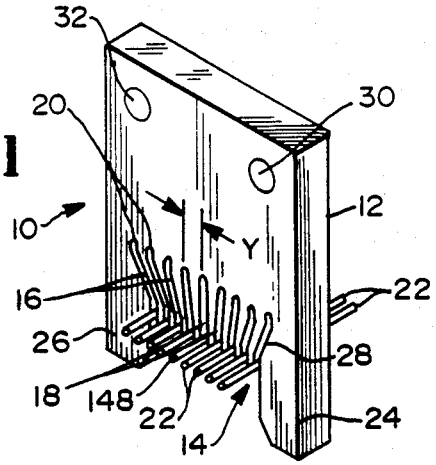
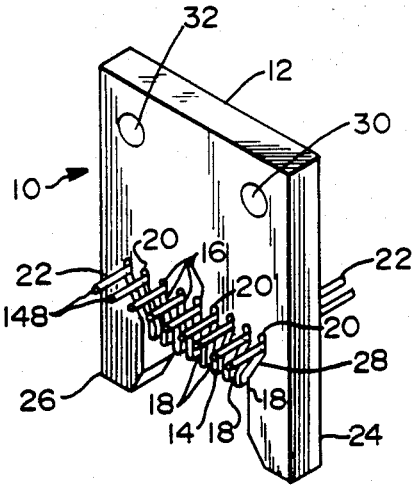
FIG.2
FIG.3
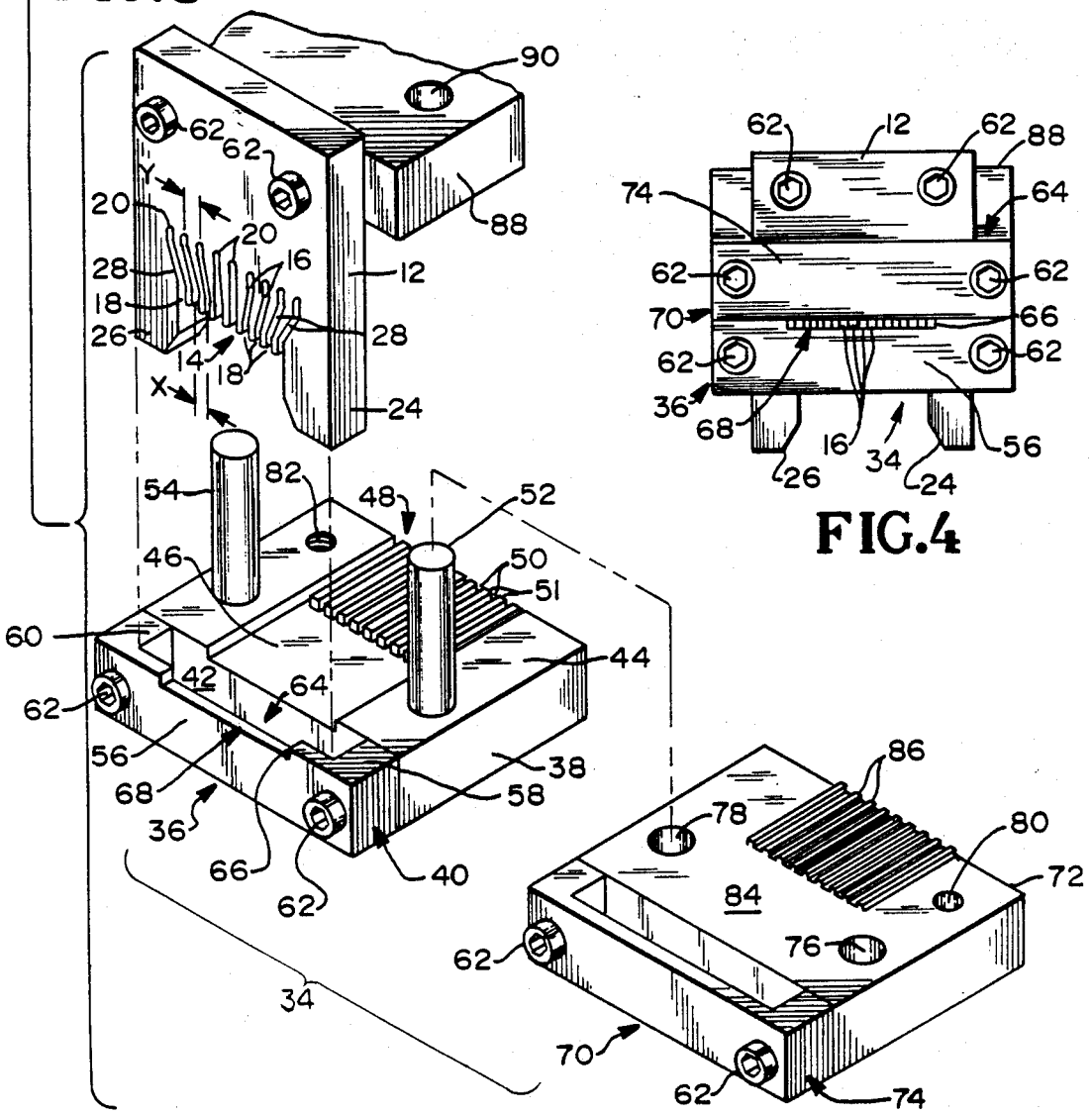
FIG.4

FIG.12
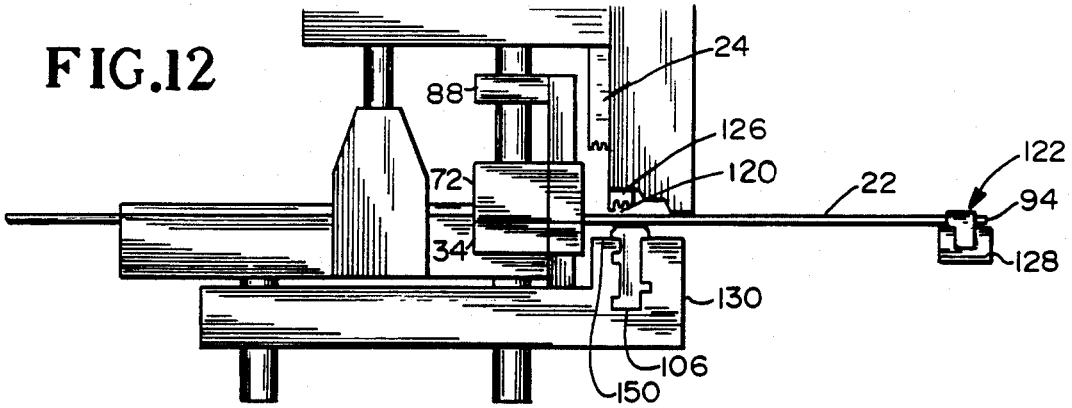
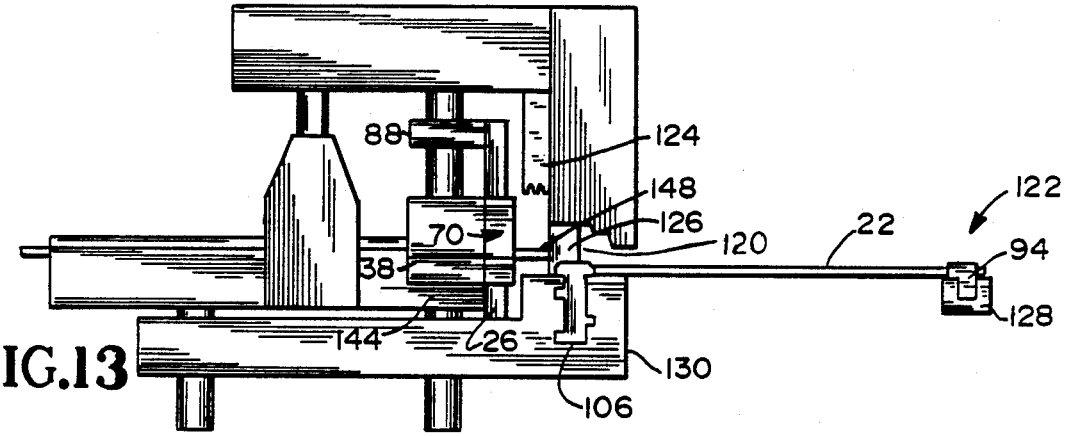
FIG.13
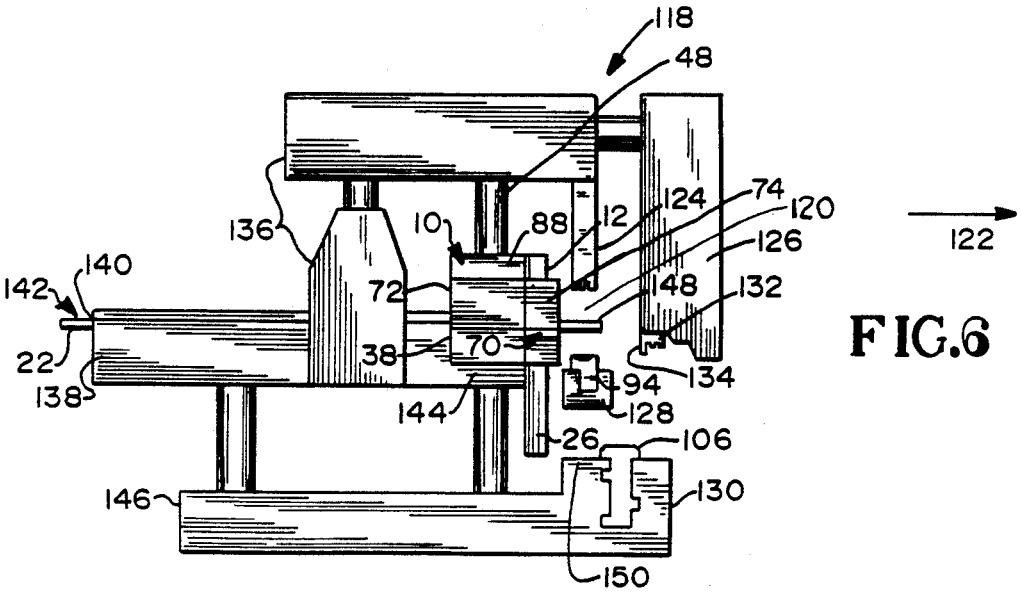
FIG.6

PITCH TRANSITION WIRE GUIDE APPARATUS

BACKGROUND OF THE INVENTION

The present invention relates to a wire management apparatus for use in a harness fabrication machine. More particularly, it relates to a wire guide apparatus for reciprocably changing the centerline spacings of adjacent wires in a discrete wire cable segment between at least two distinct pitches.

Harness fabrication machines are widely used today. Generally, harness fabricators are employed to terminate a plurality of wires in the form of either insulation-clad discrete wires or ribbon cable to multicircuit electrical connectors. An illustrative harness fabrication machine for automated mass-termination of discrete wires to insulation displacement contact connectors is described in commonly-assigned U.S. Pat. No. 4,235,015.

Wire guide means for positioning wires in proper alignment for termination in harness fabrication equipment are also known. For example, U.S. Pat. No. 4,372,041 a wire comb is mounted adjacent the termination station. The comb includes a number of parallel wire receiving channels through which the ends of a plurality of insulation clad wires are threaded. The wire comb is reciprocably moveable in an axial direction with respect to the wires. Prior to termination, the wire comb is moved towards the termination station, thereby combing, i.e. straightening and spacing, the wire ends in proper alignment so that a termination blade can readily mass-insert the wire ends into the insulation displacement slots of a connector. The wire guide apparatus disclosed in this patent does not provide a structure which permits the centerline spacing of the wires to be changed from one pitch to another, for example, to provide a continuous harness fabrication operation, wherein a variety of different connectors can be used having differing terminal centerline spacings, without interrupting production.

U.S. Pat. No. 4,476,628 describes a connector jig apparatus which includes a stacked linear array of web splitting fingers including a central rectangular cut-out portion adapted to receive an insulation displacement connector. The web-splitting fingers extend above the top surface of a nested connector on opposed sides and terminate in free ends defined by tapered cutting edges. The jig is used with flat ribbon cable to sever the web between individual cable conductors, and as the cable is forced downwardly toward the connector, the fingers spread apart, thereby re-spacing the separated individual conductors to a wider centerline spacing appropriate for termination to the connector terminals. In an alternate embodiment, the jig apparatus can accomplish sequential termination of identical pitch connectors which differ from each other in terms of circuit size, i.e., circuit number. The jig apparatus described in this patent cannot be used to accomplish smooth, continuous wire spacing transistors for discrete wire from a closer spacing to a wider spacing and back again, for the purpose of terminating the wires to different connectors which contain terminals set at different centerline spacings.

SUMMARY OF THE INVENTION

Accordingly, it is an object of the present invention to provide an apparatus for changing the centerline distance of a plurality of generally coplanar wires in a harness fabrication machine.

It is another object of the present invention to provide a wire guide apparatus in a harness fabrication machine adapted to reciprocably alter the centerline spacing of a plurality of wires between at least two distinct patches in a smooth continuous transition.

It is a further object of the present invention to provide a wire guide apparatus in a harness fabrication machine which permits automated, continuous fabrication of pitch-transition wire harnesses including a common plurality of wires terminated to different pitch connectors.

In accordance with these and other objects, the present invention provides in a harness fabrication machine, an apparatus for changing the centerline distance of a plurality of generally coplanar wires comprising:

a wire guide including a plate member having a wire engaging edge and a corresponding number of open-ended wire guide channels, each extending inwardly from the edge to a closed end, the closed end of said channels being spaced apart by a centerline spacing different from the centerline spacing of said open ends in said edge, said wire guide being reciprocally moveable between a first position wherein the open ends are engaged with the wires adjacent the edge, to a second wire receiving position wherein said wires are disposed at the closed ends, and actuation means for moving the wire guide between said first and second positions, whereby actuation of the wire guide causes movement of the wires within their respective channels to alter the centerline spacing thereof.

The plate member of the wire guide apparatus engages the wires, one wire in a corresponding channel. The plate member is actuated perpendicularly with respect to the longitudinal axes of the wires to alter the centerline spacing between them. The plate member may be actuated between the first and second positions by any conventional actuation means, such as for example an air cylinder actuator or a solenoid actuator to name a few. In a preferred embodiment, the plate member is positioned adjacent a termination station of a wire harness machine and is actuated between the first and second positions in response to positioning movement of a connector nest at the termination station. In accordance with this embodiment, at least two connector nests are provided in the harness machine. Positioning of one nest or the other at the termination station is effective to raise or lower the plate member, respectively, to present appropriately spaced wires to the termination station for termination to the connector that each particular nest carries.

The plate member may be provided with opposed channel ends which are configured to align the engaged wires, at the first and second positions of the plate member, respectively, so that the wire spacings correspond to conventional but different connector terminal centerline spacings. Accordingly, the centerline spacing of adjacent wires imparted by the open channel ends in the first position may be 0.100 of an inch and at the closed ends in the second position may be 0.118 of an inch, for example, or 0.125 of an inch.

The wire guide apparatus of this invention now permits a production run of 0.100 inch pitch wire harnesses to be performed by actuating the wire guide to the first position and by feeding 0.100" center connectors from a first connector feed to the termination station for termination to the wires. Thereafter, if a production run of 0.118" pitch harnesses is desired, the plate member is actuated to the second position and 0.118" center connectors are fed to the termination station from a second connector feed. The new and improved wire guide apparatus permits the changeover in production to occur in a substantially smooth, continuous automated manner which does not require prolonged downtime for the harness fabrication machine.

In addition, the new and improved wire guide apparatus permits continuous fabrication of pitch transition double ended and daisy-chain type wire harnesses. Accordingly, by alternating connector feeds and reciprocating the wire guide between first and second positions as appropriate prior to termination, a single wire harness having a plurality of different pitch connectors terminated to the same discrete wire cable segment, can be prepared in automated harness fabrication equipment.

The new and improved pitch transition wire guide apparatus of this invention is a relatively inexpensive apparatus for reciprocably changing the centerline spacing of adjacent wires of a discrete wire feed in a harness fabrication machine to advantageously increase the capabilities of the machine both in terms of the number and kinds of harnesses the machine can produce.

Other objects and advantages of the present invention will become apparent from the following detailed description taken in conjunction with the drawings in which:

BRIEF DESCRIPTION OF THE DRAWINGS

FIG. 1 is a perspective view of the plate member of the new and improved pitch transition wire guide apparatus of the present invention, shown in a first position in engagement with a plurality of insulation clad wires;

FIG. 2 is a perspective view of the plate member shown in FIG. 1 in a second wire engaging position wherein the centerline spacing of adjacent wires has been altered to a different pitch;

FIG. 3 is an exploded perspective view of the mounting frame and plate member of the new and improved pitch transition wire guide apparatus of the present invention;

FIG. 4 is a front elevation view of the assembled plate member and mounting frame of the new and improved pitch transition wire guide apparatus of the present invention;

FIGS. 6 through 13 schematically illustrate a preferred termination sequence employing the new and improved wire guide of the present invention in producing a pitch transition wire harness as shown in FIG. 5.

DETAILED DESCRIPTION OF THE PREFERRED EMBODIMENT

Figure 5:
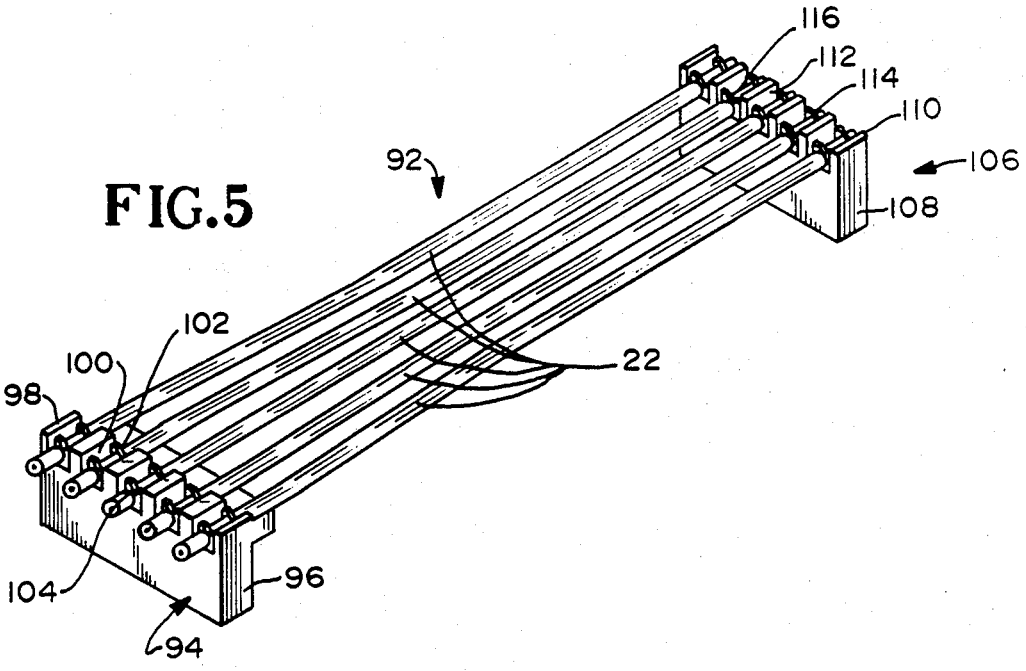
FIG. 5 is a perspective view of a pitch transition double ended wire harness produced using the new and improved wire guide apparatus of the present invention.

Referring now to FIGS. 1 and 2, in a harness fabrication machine, the new and improved apparatus of the present invention for changing the centerline distance of a plurality of generally coplanar wires comprises a wire guide 10. Wire guide 10 includes a plate member 12 having a wire engaging edge 14 and a corresponding number of open ended wire guide channels 16. Each channel 16 extends inwardly from edge 14 to a closed end 20. Opposite closed ends 20 are open ends 18 defined at edge 14. Closed ends 20 are spaced apart by a centerline spacing Y which is different from the centerline spacing X of the opposed open ends 18 defined in the wire engaging edge 14.

As shown in FIGS. 1 and 2 a plurality of insulation clad discrete wires 22 are each slideably received within a corresponding channel 16. Plate member 12 is positioned perpendicularly with respect to the longitudinal axes of wires 22. Wire guide 10 is reciprocably moveable between a first position as shown in FIG. 1 wherein open ends 18 of channels 16 are in equipment with wires 22 adjacent edge 14 and a second wire receiving position as shown in FIG. 2 wherein wires 22 are disposed at closed ends 20. An actuation means, not shown, is provided for moving the wire guide between first and second positions. As has been mentioned above, the actuation means may include an air cylinder actuator or a solenoid actuator connected to plate member 12 in a manner which is effective to reciprocably move it between the first and second positions shown in FIGS. 1 and 2 respectively.

In the preferred embodiment shown in FIGS. 1 and 2, plate member 12 is provided with elongate leg projections 24 and 26 extending away from wire engaging edge 14 from opposed sides of plate member 12. Leg projections 24 and 26 provide extensions of the plate member which are engageable in a preferred embodiment with a connector nest associated with a harness fabrication machine. Briefly, in accordance with this preferred embodiment, movement of the connector nest causes the nest to engage leg extensions 24 and 26 to effectively move or actuate the plate member 12 between the first and second positions.

The new and improved wire guide 10 of the present invention is preferably made of a low surface friction, hard material and is especially preferably stainless steel. Channels 16 are preferably provided in plate member 16 by wire electro-discharge machining methods (wire EDM) because the centerline spacing of channels 16 and the narrow gauge of the channel widths are generally too small to be provided by other forming methods, such as casting of metal plate member 12. Wire EDM methods also provide smoothly curved continuous transition sections 28 for channels 16 between the opposed ends 18 and 20.

As shown in FIGS. 1, 2 and 3, the closed ends 20 of channels 16 are spaced on adjacent centerlines Y that are wider apart than the adjacent centerline spacing X provided at the open ends 18 of channels 16. The channels 16 are each designed to receive a particular gauge wire and are arranged in plate member 12 so that ends 18 and 20 impart a different selected centerline spacing to the wires upon movement of plate member 12 with respect to the wires to the first and second positions of plate member 12. Plate member 12, as shown in FIGS. 1 and 2 may optionally be provided with mounting apertures 30 and 32 for securing the plate member to an actuator means or to a mounting frame assembly 34, shown in FIGS. 3 and 4.

Referring now to FIG. 3, a split mounting frame assembly 34 is provided which is adapted to receive and maintain plate 12 in a perpendicularly reciprocable relationship with respect to a plurality of wires 22. More particularly, frame assembly 34 includes a bottom half 36 including a rear block portion 38 and a forward portion 40. Block portion 38 includes a forward edge 42 and a top surface 44. A wire receiving recessed slot 46 is defined in top surface 44. The rearward end 48 of recessed slot 46 is provided with upstanding projections 51 forming grooves 50. A pair of mounting guide posts 52 and 54 extend upwardly from top surface 44.

Forward portion 40 comprises a generally U-shaped member including a log leg 56 and a pair of opposed short legs 58 and 60. Forward portion 40 is shown fixedly mounted to forward edge 42 of block portion 38 by means of mounting screws 62 extending through leg members 58 and 60 into threaded apertures provided in edge 42 of block 38. Forward portion 40 cooperates with forward edge 42 to define a vertically extending plate receiving passageway 64 adjacent the forward end of bottom half 36. The upper surface of leg 56 includes a cut out area 66 aligned with wire slot 46 and partly defining the forward opening 68 of slot 46.

Split frame assembly 34 also comprises a top half 70 including a complementary rear block portion 72 and top forward portion 74. Top block portion 72 is provided with a pair of spaced mounting apertures 76 and 78 which are adapted to be engaged on mounting posts 52 and 54 when top half 70 and bottom half 36 are assembled together. A screw receiving aperture 80 extends through block 72 which is adapted to register with a threaded aperture 82 in bottom block member 38; to permit the assembled parts of frame 34 to be fixed together, also by means of a screw 62. The inner facing surface 84 of top block 72 is also provided with raised wire stuffing projections 86 which are designed to cooperate with grooves 50 in block 38 to urge wires 22 entering wire slot 46 into grooves 50.

The top forward portion 74 is mounted to the front edge of top block 72 in a manner similar to front portion 40 and is adapted to cooperate with bottom half 36 to further define plate receiving passageway 64 and forward wire slot opening 68 in frame assembly 34.

As shown in FIG. 3, plate 12 is fixedly attached at its upper end to a stabilizer plate 88 by means of mounting screws 62. Stabilizer plate 88 extends perpendicularly rearward from wire guide plate 12 and is provided with a pair of guide apertures 90 adapted to be slidably received on mounting guide posts 52 and 54. Mounting guide posts 52 and 54 and passageway 64 cooperate with apertures 90 and plate member 12 to effectively limit movement of guide plate 12 in a substantially perpendicular direction with respect to wire receiving slot 46.

The assembled wire guide apparatus 10 is shown in FIG. 4 in a rest position. As shown in FIG. 4, forward portions 40 and 74 cooperate to define the forward opening 68 to wire receiving slot 46. Wire guide plate 12 extends within plate receiving passageway 64 in a manner which perpendicularly intersects wire slot 46. The wire guide channels 16 cooperate with wire slot 46 to define openings through which wires can be advanced through the wire guide apparatus 10 from rear to front.

In the rest position shown in FIG. 4, plate member 12 is in a lowered position with respect to mounting frame 34 such that stabilizer plate 88 rests on the upper surface of top block 72 and projecting leg portions 24 and 26 of plate member 12 extend for a distance below the bottom surface of bottom half 36. In this rest position, the wire slot 46 intersects the wire guide channels 16 in plate member 12 adjacent closed ends 20. This corresponds with what has earlier been referred to as the second position of the wire guide plate 12. In accordance with a preferred embodiment, a portion of a connector nest on its way to a termination station engages the lower ends of leg projections 24 and 26 of plate 12. As the connector nest is further moved upwardly into its position at a termination station, the nest will simultaneously cause the wire guide plate 12 to move upwardly in passageway 64 with respect to frame assembly 34 to the aforementioned first position of the plate member. In the process, wires engaged within channels 16 will slide in the channels to assume the centerline spacing imparted by open channel ends 18 in the plate member 12. Reciprocal movement of the guide plate 12 within passageway 64 between the first and second positions is effective to change the centerline spacing of the wires exiting through forward slot opening 68 between the two discrete spacings provided at the open end and closed ends of channels 16.

The new and improved pitch transition wire guide apparatus 10 is intended for use in a harness fabrication machine. Many different kinds of harness fabrication machines are commercially available and are in use. Generally, all include a termination station whereat a plurality of wires are terminated to the terminals of a multicircuit connector. Connector feeding and positioning means are provided to locate connectors one at a time at the termination station. Wire feeding means are provided to advance an aligned set of wires from a wire supply to the termination station. Termination means are provided at the termination station for individually or mass-inserting the set of wires into the insulation displacement slots of the terminals of the connector. The harness fabricators also generally include a cutting means to sever a completed wire harness from the advancing wire supply and ejectment means.

Some harness fabricators assemble pre-cut wire lengths in parallel spaced relationship and move the array of wires to a termination station. A connector is attached at one end and the wires are rotated on a turntable to presentthe opposed wire ends for termination. In other fabricators, two termination stations are provided and opposed wire ends are simultaneously terminated with connectors.

In still other harness machines, double-ended or daisy-chain harnesses are prepared from a single wire supply and single termination station by terminating a first connector to wire ends. Thereafter, the connector is moved out of the termination station, pulling the wires along with it, to present a second portion of the wires at the termination station for attachment to a second connector. Other modified variations are known for terminating one and two part connectors to discrete wires.

Generally, the wire guide apparatus 10 can advantageously be positioned adjacent a termination station and used in any harness fabrication machine wherein it is desired that the connector feed contain a series of differing connectors whose terminals are located on different centerline pitches. In these applications there is a need to change the spacings between adjacent wires of a wire feed in order to terminate them.

In accordance with the present invention, the new and improved wire guide apparatus 10 can be used in a harness fabrication machine to permit fabrication of a pitch transition wire harness 92 as shown in FIG. 5. Wire harness 92 includes a first multicircuit insulation displacement connector 94 disposed at one end thereof. Connector 94 includes a dielectric housing 96, including an upper surface 98 including five spaced apart wire receiving slots 100. Five insulation displacement contact terminals 102 are mounted in connector housing 96 such that their insulation displacement slots 104 are aligned with wire receiving slots 100 at the upper surface 98 of the housing 96. For purposes of illustration, the centerline spacing of adjacent insulation displacement slots 104 of connector 94 is manufactured to be 0.118". Connector 94 can be commonly referred to as a 118 center connector.

Pitch transition wire harness 92 additionally includes a second multicircuit insulation displacement connector 106 shown at the opposed end of harness 92. Connector 106 also comprises a dielectric housing 108 having a configuration different from housing 96 but also including an upper surface 110 including wire receiving slots 112 having terminals 114 mounted therein. Terminals 114 also include five insulation displacement slots 116 aligned with slots 112. Connector 106 is manufactured to provide a centerline spacing between adjacent insulation displacement slots 116 or 0.100 inch. Connector 106 may be referred to as a 100 center connector.

Pitch transition harness 92 additionally includes five parallel spaced apart insulation clad wires 22 terminated at each end to insulation displacement connectors 94 and 106. The wire harness 92 is adapted for making electrical connections between two external components, not shown, which include electrical contacts set at 118 and 100 center spacing, respectively. In accordance with the present invention, a pitch transition wire harness such as 92 may now be prepared in a smooth, continuous, fully-automated manner using modified conventional harness fabrication equipment which incorporates wire guide apparatus 10.

Referring now to FIGS. 6 through 13 the operation of the new and improved wire guide apparatus 10 in a harness fabrication machine, for making pitch transition wire harness 92 is shown.

More particularly, the new and improved wire guide apparatus 10 of the present invention is illustrated in a harness fabrication machine 118 illustrated schematically in FIGS. 6 through 113. Harness fabrication machine 118 illustrated in the figures is of the type described in U.S. Pat. No. 4,235,015, assigned to the assignee of the present invention and specifically incorporated herein by reference. Generally, this type harness fabrication machine 118 is designed to mass terminate a coplanar parallel spaced array of discrete wires in respective insulation displacement contact terminals of a connector at a termination station, generally designated at 120 in the figures.

In accordance with the general method taught in this patent, wires 22 are fed from a wire supply through a wire feed, not shown, which advances wires 22 toward termination station 120 in a parallel spaced coplanar fashion. A connector feed is provided which generally includes a connector supply, such as a feeder bowl apparatus or the like, not shown, which advances individual multicircuit connectors along a delivery track to a delivery station. A connector shuttle means is provided which advances connectors from the delivery station to a connector nest which is movable to position the connector at termination station 120. Reciprocable termination blades are provided above the termination station. The blades are lowered to force the wires into respective insulation displacement slots within the connector terminals in a simultaneous mass insertion stroke. Thereafter, the connector nest is moved to a second station 122 withdrawing the terminated wires therewith to present a second portion of discrete wires 22 at termination station 120 for termination to a second connector. The second connector is fed to termination station 120 by means of a second connector nest which positions the second connector under extended wires 22 which in turn lie under the termination blade. Wire cutting means are also provided at termination station 120 to sever a completed wire harness 92 from the discrete wire feed supply and ejection means are provided for ejecting completed harness 92 out of fabrication machine 118 to a storage or shipment container or the like.

Referring now to FIG. 6, a modified harness fabrication apparatus 118 is shown. Harness fabrication apparatus 118 has been modified to include two independently actuable termination blades 124 and 126. Harness fabricator 118 also is provided with two independently actuable connector nest structures 128 and 130. Termination blade assembly 124 is dedicated to termination of a 118 pitch connector 94 shown in FIG. 5. Termination blade 124 includes a plurality of wire insertion blades 132 aligned to force insulation clad wires 22 into insulation displacement slots 104 of terminals 102 through the wire receiving slot openings 100 in the top surface 98 connector 94.

Termination blade assembly 126 includes a plurality of wire insertion blades 132, as well as, a cable cutting blade 134 adapted to sever an otherwise completed wire harness 92 from the wire feed. Second termination blade assembly 126 is laterally reciprocable toward and away the first termination blade assembly 124 in addition to being vertically reciprocable towards termination station 120. Both blade assemblies 124 and 126 are independently mounted through actuation means 136 to a table member 138.

Table member 138 includes an upper surface 140 including a wire receiving trough 142. Mounted at the forward end 144 of table 138 immediately adjacent termination station 120 is new and improved wire guide apparatus 10 of the present invention.

As shown, split mounting frame 34 is mounted at forward end 144 so that the rearward block portions 38 and 72 are disposed on table 138 and plate passageway 64 and forward portions 40 and 74 are disposed over the forward edge 144 of the table 138. The double ended wire receiving slot 46 extending through the split mounting frame assembly 34 is aligned with the wire trough 142 of table member 138. The wire guide plate member 12 is mounted in passageway 64 and is reciprocably moveable in a substantially perpendicular direction with respect to wire-receiving slot 46 and wire trough 142. The leg extensions 24 and 26 of plate 12 extend below the underside surface of table 138. The entire table apparatus 138 is reciprocable in a vertical direction in a short vertical stroke as will be more particularly described hereinafter.

Also shown in FIG. 6 is a second connector nest 130 adapted to receive and position a 100 center connector 106 shown in FIG. 5. Second connector nest 130 is shown loaded with a connector 106. Connector nest 130 is mounted to a carrier member 146 which also is adapted for vertical reciprocable movement with respect to termination station 120 and table assembly 138.

In the starting position shown in FIG. 6, a plurality of wires 22 are advanced from a wire supply, not shown, along wire trough 142 in table member 138. The wires enter the rearward opening of wire slot 46 in split mounting frame assembly 34 and are slidingly received within grooves 50 in lower rear block portion 38. The raised stuffing projections 86 provided in the top block portion 72 urge wires 22 down into grooves 50 to prealign wires 22 so that they each pass through a corresponding guide channel 16 in plate member 12. In accordance with this apparatus, wires 22 extend through slot 46, passageway 64, channels 16 in plate member 12, and exit from forward slot opening 68 to termination station 120.

In the starting position shown in FIG. 6, wire guide plate 12 is shown in its second or lowered position wherein the individual wires 22 are disposed adjacent the closed channel ends 20 of plate member 12. Channel ends 20 have been machined in plate member 12 in order to impart a centerline spacing to a predetermined gauge of insulation clad wires of 0.118 inch. The wires 22 exiting the forward opening 68 in wire slot 46 will advance toward termination station 120 with 0.118 inch spacing between the wires.

Figure 7:
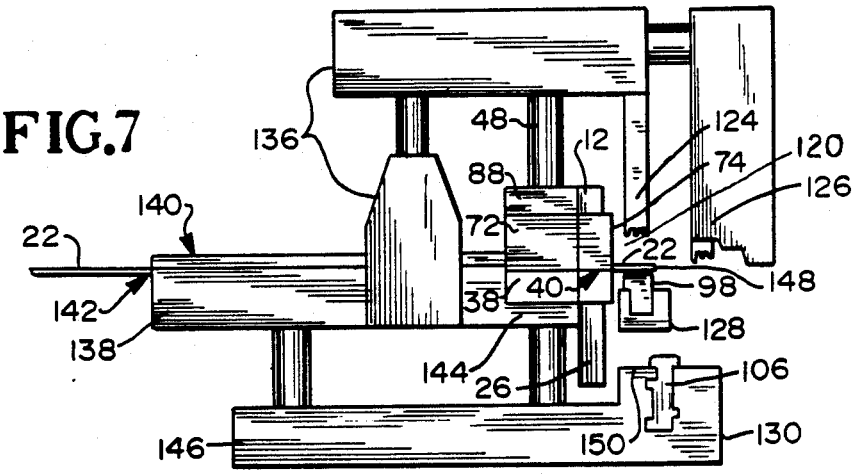

The beginning of the termination sequence is illustrated schematically in FIG. 7. As shown in FIG. 7, a first connector nest 128 carrying 118 center connector 94 has been moved into position termination station 120. The entire table assembly 138 has been fractionally lowered and leading ends 148 of discrete wires 22 extend from the front slot opening 68 into the termination station 120 disposed at 0.118 centerline pitch. Termination blade 124 is shown in its raised position above conductors 22 and connector 94. In this starting position, second termination blade 126 and second connector nest 130 are in their starting positions remote from the termination station 120. In FIG. 7, the wire ends 148 are appropriately positioned above insulation displacement slots 104 in connector 94.

Figure 8:
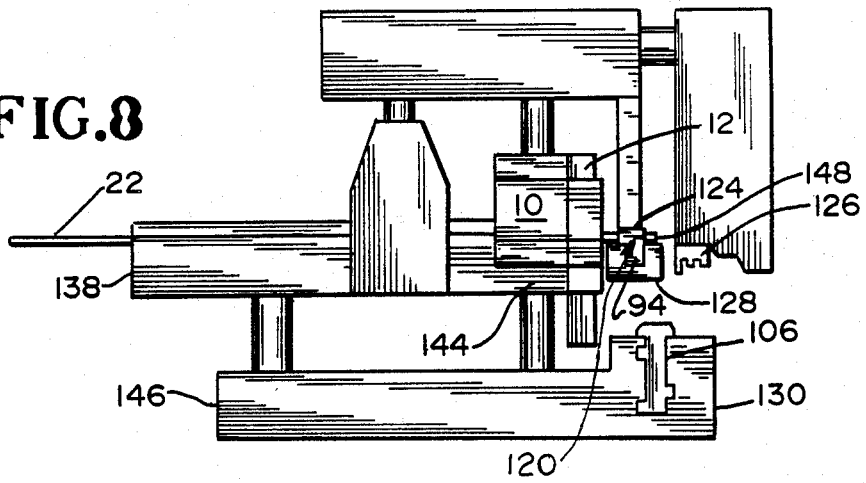

FIG. 8 shows the termination step for connector 94, wherein termination blade 124 is actuated toward connector 94 which forces insulated wire leads 148 into the insulation displacement slots 104 of connector 94.

Figure 9:
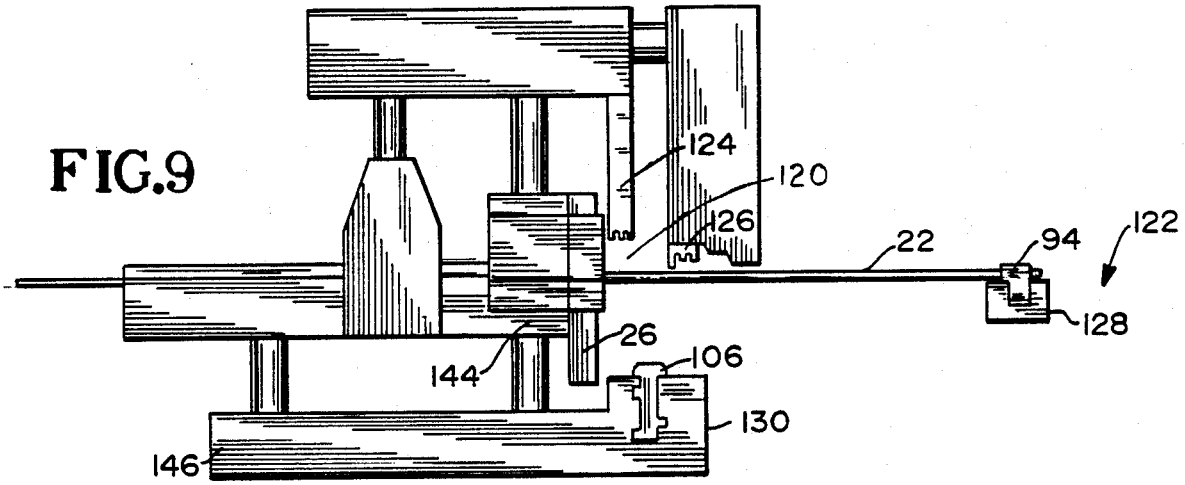

The next terminating sequence step is illustrated in FIG. 9, wherein termination blade 124 is reciprocated upwardly to its rest position and connector nest 128 is moved axially out of the termination station 120 to second station 122. Movement of connector nest 128 to station 122 is effective to draw the terminated connector 94 and wires 22 from the wire feed through the wire guide apparatus 10 to present a second portion of wires 22 at the termination station 120.

Figure 10:
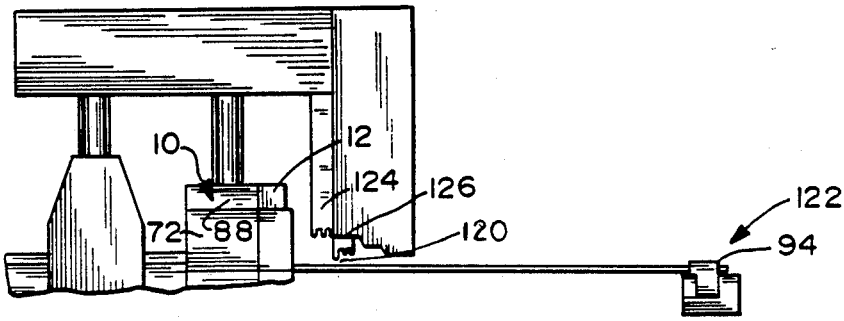
Figure 11:
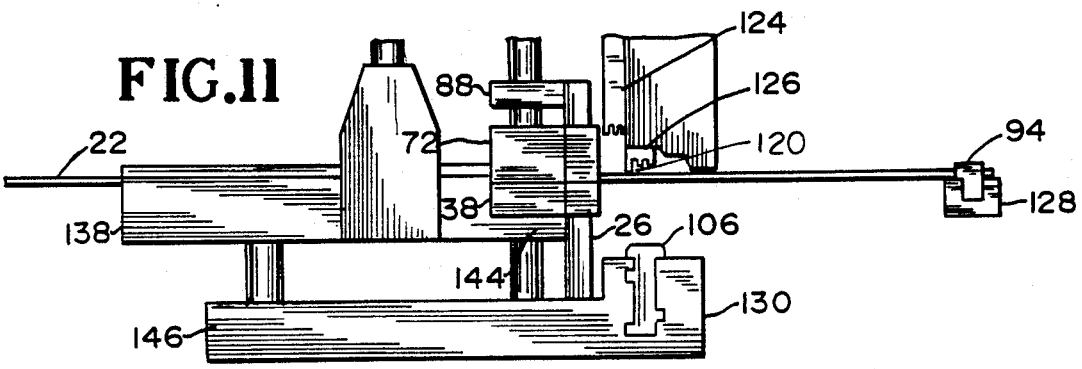

Turning now to FIGS. 10 through 12, the terminating sequence for the second connector 106 is shown. FIG. 10 shows inward reciprocation of termination blade 126 so that termination blade 126 abuts against termination blade 124. Inward movement of termination blade 126 to this position places it in overlying alignment with connector 106 nested within connector nest 130, which is still at this point disposed below termination station 120.

After second termination blade 126 has been moved to position above termination station 120, connector nest 130 and carrier 146 is actuated upwardly to move connector 106 into termination station 120. In the process, the upper surface of carrier 146 engages downwardly extending leg portions 24 and 26 of plate member 12 pushing it up through passageway 64 until plate member 12 assumes a first position with respect to the plurality of wires 22 extending through the split frame member 34. In this position, wires 22 are engaged at the open ends 18 of channels 16. Upward movement of plate member 12 has caused the centerline distance between adjacent wires 22 to be changed to 0.100 inch. Carrier 146 also raises table assembly 138 to its original upward position. The 100 pitch connector 106 is now in termination position at termination station 120, wherein the insulation displacement slots 116 connector 106 are aligned immediately underneath wires 22.

Thereafter, as shown in FIG. 13, termination blade assembly 126 is actuated downwardly in a termination stroke to force wires 22 into the insulation displacement slots 116 mounted in connector 106. Simultaneously wire cutting blade 134 cuts through the wires 22 disposed over a top portion 150 of connector nest 130. Top portion 150 includes a blade receiving member, not shown, adapted to prevent premature dulling of cutting blade 132.

In the process cutting blade 132 is urged against the upper surface of connector nest 130 to sever the completed terminated harness 92 from the wires 22 to form a new supply of wire ends 148. After completed wire harness 92 has been severed from wires 22, ejection means, not shown, move the completed pitch transition cable harness 92 laterally out of the respective connector nest 128 and 130 to a storage container or a harness delivery track.

After ejection, the termination cycle is completed by actuating connector nest 130 to its original position as shown in FIG. 6. Second termination blade 126 is outwardly actuated to its initial starting position. In the process of lowering connector nest 130, plate member 12 of wire guide apparatus 10 is once again lowered to its second position wherein wire leads 22 are engaged at the closed ends of channel 16. Thereafter, connector nest 128 is moved to its initial starting position to pickup another 118 pitch connector 94. Thereafter, the next harness fabrication sequence can be performed.

As illustrated schematically in FIGS. 6–13 movement of the connector nest 130 may provide the actuation means for reciprocably moving wire guide plate member 12 between first and second positions to respace the wire ends 148 presented at termination station 120. The pitch transition imparted to the wires 22 by wire guide apparatus 10 may be smoothly accomplished in the described manner without any machine shutdown for changeover being required.

The application and use of the new and improved pitch transition wire guide apparatus in different types of harness fabrication machines will be readily apparent to those skilled in this art. If the harness fabrication machine includes more than one termination station, independently actuable wire guides 10 can be positioned at each one. Moreover, the wire guide apparatus 10 can be used in harness fabrication equipment for terminating wires to connectors which do not include insulation displacement type contacts.

Although the present invention has been described with reference to a preferred embodiment, still other modifications or changes may be made therein by those skilled in this art, without departing from the scope and spirit of the present invention as defined by the appended claims.

We claim:

1. A machine for making a wire harness, said harness including a plurality of parallel, coplanar insulation clad wires terminated to at least two spaced-out connectors, each connector having a corresponding number of contacts for electrically engaging said wires, the centerline spacing of the contacts of the first and the second connectors being different, said machine including:

a termination station whereat wires are terminated to contacts of a connector; means for positioning a connector at the termination station; means for feeding the wires to the termination station; wire positioning means at the termination station for presenting the wires in alignment with the contacts of a connector positioned thereat; and pitch-controlling wire management means for changing the spacing of the wires from a first distance to a second distance equal to the centerline distance of the contacts of the connector at the termination station;

the improvement comprising:

said connector positioning means including a first connector nest for said first connector and a second connector nest for said second connector, said first and second connector nests being selectively and independently moveable to and from said termination station; and said wire management means having means for engaging and sensing which connector nest is at the termination station and means cooperating with said connector positioning means to selectively change the centerline spacing of the wires to the contact spacing of the particular connector in the nest positioned at the termination station.

2. A machine as in claim 1 wherein said wire feeding means and said wire positioning means present the wires in parallel coplanar relationship to the termination station.

3. A machine as in claim 2, wherein said parallel coplanar wires define a first horizontal plane extending through said termination station and in said connector positioning means said first connector nest is movable to and from said termination station in a second horizontal plane extending parallel to and disposed below and adjacent said first horizontal plane and said second connector nest is vertically reciprocally moveable to and from said termination station from a rest position disposed below said second horizontal plane.

4. A machine as in claim 3, wherein said wire management means includes a reciprocally mounted wire guide including a plate member having a wire engaging edge and a corresponding number of open-ended wire guide channels, each of said channels extending inwardly from the edge to a closed end, the closed ends of said channels being spaced apart by a centerline spacing different from the centerline spacing of said open ends in said edge, said wire guide being vertically movable with respect to said wires between a normal lowered first wire-receiving position wherein the wires are engaged in said channels and disposed adjacent the closed ends and a second raised wire-receiving position wherein the wires are engaged in the channels adjacent the open ends, the first wire-receiving position imparting a centerline spacing to the wires corresponding to the contact centerline spacing of the first connector and the second wire-receiving position imparting a centerline spacing to the wires corresponding to the contact centerline spacing of said second connector.

5. A machine as in claim 4 wherein said wire management means, said engaging means and said cooperating means include a pair of leg projections extending from said wire engaging edge on opposed sides of said open ends and said connector positioning means includes a surface on said second connector nest positioned to engage the leg projections when the second connector nest is moved from said rest position to the termination station, which movement is effective to cooperatively move the plate member from said first wire receiving position to said second wire receiving position.

6. A machine as in claim 5, wherein said wire positioning means includes a mounting frame having a block member with an open ended wire receiving slot extending therethrough coplanar with the first horizontal plane and a plate-receiving passageway within which the plate member is reciprocally moveable extending perpendicular to and intersecting the wire receiving slot to position and hold said wires so that portions thereof extend through the channels and the passageway and exit to the termination station.

7. The machine as in claim 6 wherein in said first wire-receiving position, said leg projections of the plate member extend out of said passageway and below a bottom surface of said block member.

8. A machine as in claim 7 wherein said wire guide further includes a stabilizer plate extending perpendicularly from said plate member on a slide opposite the termination station and disposed to abut a top surface of said block member when the plate member is in said first-wire receiving position to prevent further downward movement of the plate member within said passageway.

9. A machine as in claim 1, wherein the contacts in said first and second connectors are insulation displacement contacts and said termination means includes a termination blade assembly for pushing the wires into the insulation displacement contacts.

* * * * *